US008683711B2

(12) United States Patent
Han et al.

(10) Patent No.: US 8,683,711 B2
(45) Date of Patent: Apr. 1, 2014

(54) HOUSING FOR MODULIZING HEAT PUMP SYSTEM IN A CLOTHES DRYER AND CLOTHES DRYER HAVING THE SAME

(75) Inventors: Dong-Joo Han, Gyeongsangnam-Do (KR); Jung-Wook Moon, Gyeongsangnam-Do (KR); Seung-Phyo Ahn, Gyeongsangnam-Do (KR); Hyun-Uk Lee, Gyeongsangnam-Do (KR); Byeong-Jo Ryoo, Gyeongsangnam-Do (KR); Chang-Woo Son, Busan (KR)

(73) Assignee: LG Electronics Inc., Seoul (KR)

( * ) Notice: Subject to any disclaimer, the term of this patent is extended or adjusted under 35 U.S.C. 154(b) by 669 days.

(21) Appl. No.: 12/158,274

(22) PCT Filed: Dec. 12, 2006

(86) PCT No.: PCT/KR2006/005404

§ 371 (c)(1),
(2), (4) Date: Jun. 19, 2008

(87) PCT Pub. No.: WO2007/073052

PCT Pub. Date: Jun. 28, 2007

(65) Prior Publication Data

US 2008/0289209 A1 Nov. 27, 2008

(30) Foreign Application Priority Data

Dec. 21, 2005 (KR) ..... 10-2005-0127266

(51) Int. Cl.
*F26B 21/00* (2006.01)
*D06F 58/20* (2006.01)

(52) U.S. Cl.
CPC ..... *D06F 58/206* (2013.01)
USPC ..... 34/74; 34/134

(58) Field of Classification Search
USPC ..... 34/72, 73, 77, 78, 595, 604, 134, 139, 34/74
See application file for complete search history.

(56) References Cited

U.S. PATENT DOCUMENTS

| | | | | |
|---|---|---|---|---|
| 2,847,834 | A * | 8/1958 | Atchison | 62/263 |
| 4,621,438 | A * | 11/1986 | Lanciaux | 34/77 |
| 7,409,776 | B2 * | 8/2008 | Ono et al. | 34/77 |
| 7,465,156 | B2 * | 12/2008 | Lee | 417/417 |

FOREIGN PATENT DOCUMENTS

| | | | |
|---|---|---|---|
| AT | 369 529 | | 1/1983 |
| DE | 3419743 | A1 | 11/1985 |
| DE | 3609767 | A1 | 9/1987 |
| DE | 42 12 697 | A1 | 10/1993 |
| DE | 42 12 700 | A1 | 10/1993 |
| DE | 42 14 672 | A1 | 11/1993 |
| EP | 0 163 265 | A2 | 12/1985 |
| EP | 467188 | A1 * | 1/1992 |
| EP | 1 411 163 | A2 | 4/2004 |

* cited by examiner

*Primary Examiner* — Jiping Lu
(74) *Attorney, Agent, or Firm* — Birch, Stewart, Kolasch & Birch, LLP

(57) ABSTRACT

A housing for modularizing a heat pump system of a clothes dryer and a clothes dryer having the same are disclosed. The heat pump system modularized housing of the clothes collectively modularizes a condenser, a compressor, an evaporator and an expansion valve that constitute the heat pump system of the clothes dryer. Not only does the heat pump system is stably mounted in the clothes dryer but also components of the heat pump system can be effectively protected. In addition, the fastening procedures of each component can be unified to simplify an assembling process of the clothes dryer, and thus, the productivity can be improved. Moreover, a structure of an internal flow path of the clothes dryer can be simplified to thus improve efficiency of the heat pump system.

7 Claims, 6 Drawing Sheets

HOUSING FOR MODULIZING HEAT PUMP SYSTEM IN A CLOTHES DRYER AND CLOTHES DRYER HAVING THE SAME

TECHNICAL FIELD

The present invention relates to a clothes dryer and, more particularly, to a clothes dryer having a housing in which a heat pump system is modularized.

BACKGROUND ART

The clothes dryer can be divided into an exhaust type clothes dryer and a condensing type clothes dryer depending on how moist air generated while drying target items to be dried is processed. In the former type clothes dryer, the moist air discharged from the dryer is exhausted, while in the latter type dryer, the moist air discharged from the dryer is condensed to deprive of moisture and the moisture-free air is re-circulated.

In general, in the clothes dryer, air heated to a high temperature by using heater is blown into a drum so that the air at high temperature can absorb moisture from target items to be dried, thus performing the drying process.

The related art clothes dryer in which heat is transferred to introduced air by using a heater is advantageous in that the overall drying time can be shortened by quickly heating air by means of the heater and the dryer can be fabricated with a larger capacity, but has shortcomings in that much energy is consumed to heat the introduced air by using the heater. In particular, because the target items are dried with air at a temperature of 100° C. or higher, there is a high possibility that the target items to be dried may be damaged during the drying process depending upon the material.

Meanwhile, the condensing type clothes dryer does not need an exhaust duct for discharging air, so it can be advantageously fabricated as a built-in type dryer. Also, it has a higher energy efficiency compared with the exhaust type clothes dryer but is disadvantageous in that it takes a long time to dry target items and because it has large capacity, it is not easy to fabricate it.

Therefore, an improved clothes dryer that may have a high energy efficiency and does not damage target items to be dried is in demand.

In addition, the improved clothes dryer is expected to have good assembly characteristics and mass-productivity in order to reduce the fabrication cost and increase productivity.

DISCLOSURE OF THE INVENTION

The present invention has been made in view of the above-mentioned problem, and it is one object of the invention to provide a clothes dryer that has a clothes dryer including a heat pump system, not a heater, as a heat source.

It is another object of the invention to provide a housing for modularizing a heat pump system of a clothes dryer that allows the heat pump system to be effectively mounted within the clothes dryer.

It is still another object of the invention to provide a housing for modularizing a heat pump system of a clothes dryer capable of assembling characteristics and mass-productivity of the heat pump system.

To achieve the above objects, there is provided a housing for modularizing a heat pump system of a clothes dryer capable of collectively modularizing a condenser, a compressor, an evaporator and an expansion valve that constitute the heat pump system of the clothes dryer.

To achieve the above objects, there is further provided a clothes dryer that may include: a cabinet; a drying drum rotatably installed within the cabinet; a heat pump system that provides heat to target items to be dried received in the drying drum; and a heat pump system modularized housing that collectively modularizing a condenser, a compressor, an evaporator and an expansion valve that constitute the heat pump system.

Herein, one end of the housing may have a first space part having a first opening and the other end of the housing may have a second space part having a second opening, the first and second space parts being integratedly formed, and a through hole can be formed between the first and second space parts.

The housing for modularizing the heat pump system of the clothes dryer not only allows the heat pump system to be stably mounted but also effectively protects each component of the heat pump system. In particular, the fastening procedures of each component can be unified to simplify an assembling process of the clothes dryer, and thus, the productivity can be improved. In addition, a structure of an internal flow path of the clothes dryer can be simplified to improve efficiency of the heat pump system.

The housing for modularizing the heat pump system of the clothes dryer, and the clothes dryer having the same according to the exemplary embodiment of the present invention are advantageous in that the elements of the heat pump system, namely, the evaporator, the compressor and the expansion valve are assembled into a single module to have an integrated flow path structure.

Accordingly, the heat pump system can be easily mounted in the clothes dryer. In addition, because the components of the heat pump are not separately positioned but constructed as the single independent module, the single module can be flexibly mounted in the clothes dryer at various angles.

Moreover, each component of the heat pump system can be effectively mounted and effectively disposed in terms of spatial relation with other components, and the overall assembling process can be simplified.

MODES FOR CARRYING OUT THE PREFERRED EMBODIMENTS

A clothes dryer including a heat pump system according to an exemplary embodiment of the present invention will now be described in detail with reference to the accompanying drawings.

Figure 1:
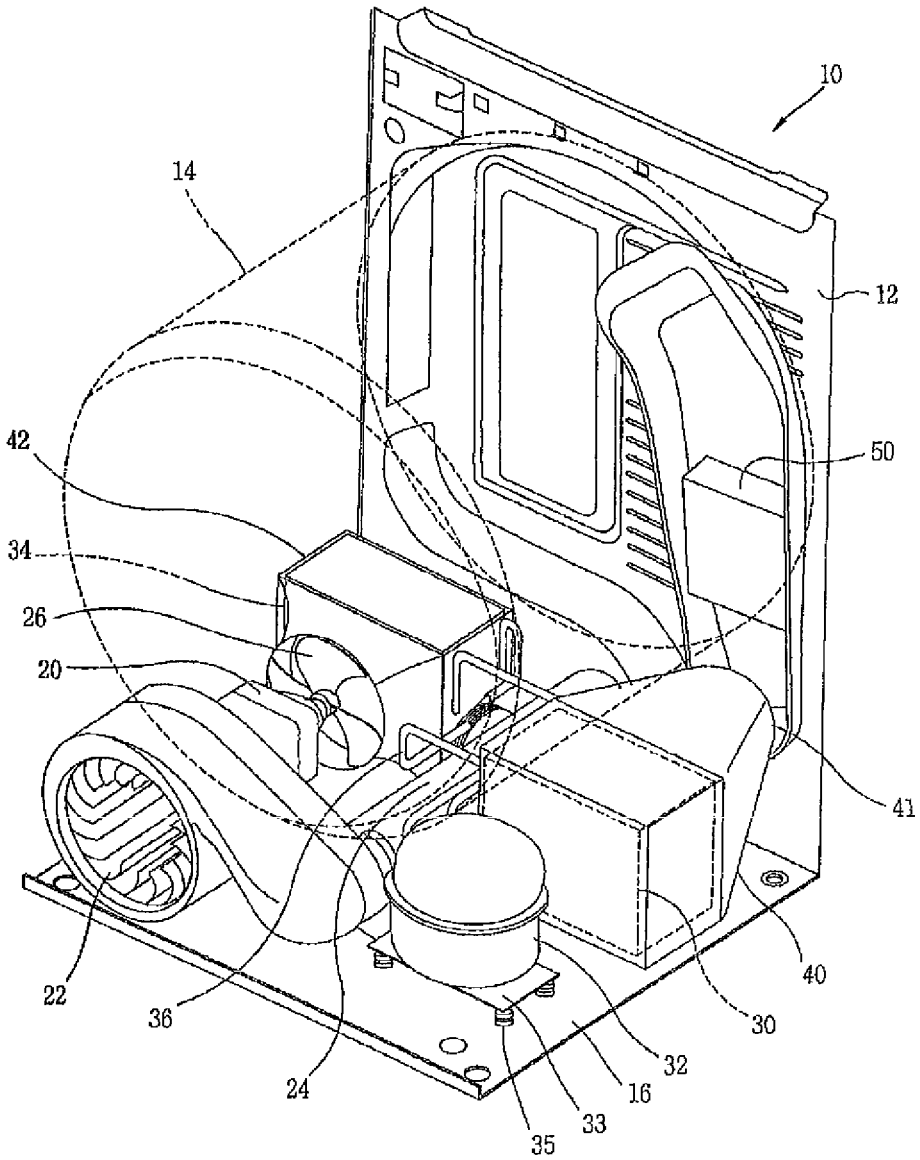
FIG. 1 is a view schematically showing a clothes dryer having a heat pump system according to an exemplary embodiment of the present invention.

FIG. 1 is a view schematically showing a clothes dryer having a heat pump system according to an exemplary embodiment of the present invention.

With reference to FIG. 1, the clothes dryer including a heat pump system according to an exemplary embodiment of the present invention includes a cabinet 12, a drying drum 14 rotatably installed within the cabinet 12, and a heat pump system that provides heat to target items to be dried (referred to as 'target items' hereinafter) received in the drying drum 14.

The drying drum 14 in a cylindrical shape is installed within the cabinet 12 and various components are mounted at a lower side of the drying drum 14, namely, on a base 16 of the bottom surface. This disposition is advantageous in that the internal space of the clothes dryer can be effectively utilized to optimize a size of the clothes dryer.

Both ends of the drying drum 14 are opened and closed by front and rear portions (not shown). Air flow paths are formed at both ends of the drying drum 14 and are connected with an air inlet that provides air at high temperature by a heat source and an air outlet that discharges air moistened as it has dried the target items.

An air flow fan 22 is mounted on the bottom surface to provide an air flow with a certain air volume and flow velocity and connected with a motor 20 to receive a rotary force thereof. The motor 20 may transfer the rotary force to the drying drum 14 by means of a power transfer unit, e.g., a belt (not shown). One end of the air flow fan 22 is connected with one side of the drying drum 14 and the other end thereof is connected with an air outlet duct 24 through which moist air is discharged. The air outlet duct 24 extends to a rear surface of the cabinet 12 to finally discharge the moist air to outside.

Components of the heat pump system as a heat source are disposed on the base 16 of the bottom surface of the cabinet 12. A compressor 32 is mounted at a front portion of the base 16 and a condenser 30 is mounted as a first heat exchanging unit at a rear side thereof. An evaporator 34 is mounted as a second heat exchanging unit at a rear side of the motor 20, and an auxiliary fan 26 is mounted in front of the evaporator 34. The auxiliary fan 26 generates an air flow toward the evaporator 34 or the motor 20, and when the air flow is generated toward the evaporator 34, not only heat exchanging of the evaporator 34 can be accelerated but also condensation water generated from a surface of the evaporator 34 can be effectively removed.

In addition, in order to prevent vibration and noise when the compressor 32 is driven, the compressor 32 is installed on a support plate 33 by using a fastening means such as a screw. The support 33 is installed on the base 16 by using the fastening means such as the screw, and a vibration reducing member 35 such as rubber is positioned between the support plate 33 and the base 66.

The condenser 30 and the evaporator 34 are separately covered housings 40 and 41 and positioned at each independent flow path. The condenser 30 is positioned at a first air flow path formed by the first housing 40 and one end 41 of the first housing 40 is connected with the air inlet of the drying drum. Air at high temperature due to passing through the condenser is introduced into the drying drum 14 to dry the target items (not shown) and then externally discharged through the air outlet duct 24. Meanwhile, the evaporator 34 is positioned at a second air flow path formed by the second housing 42. A rear end of the second housing 42 corresponds to a rear surface of the cabinet 12 of the clothes dryer and preferably has an opened structure to allow the air heat exchanged with the evaporator 34 to be externally discharged.

The components of the heat pump system are connected by ducts 36.

The heat pump system has high efficiency compared with a clothes dryer having only a heater as a heat source, and is especially advantageous that it can prevent the target items from being damaged by the air at high temperature.

In addition, by installing a heater 50 at a passage through which air is introduced to the drying drum 14, it can provide heat together with the heat pump system to thus operate the clothes dryer in various modes according to a state of the target items and a drying stage.

Figure 2:
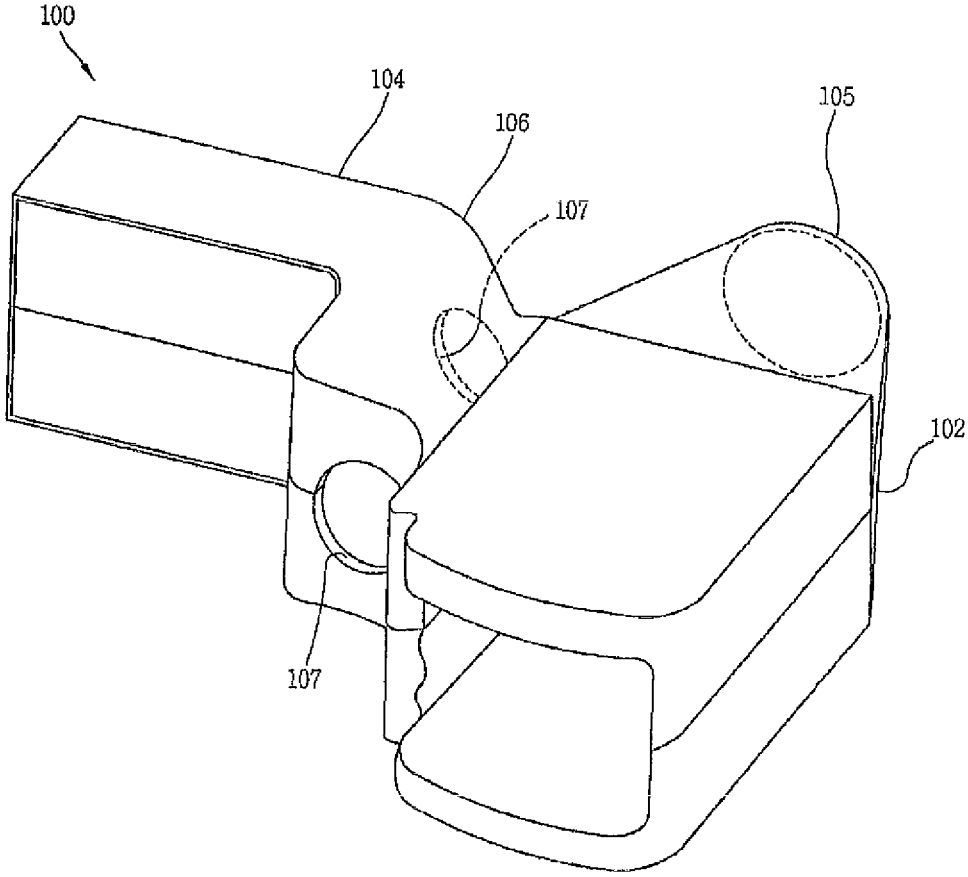
FIG. 2 is a view showing separated upper and lower portions of a heat pump system modularized housing.
Figure 3:
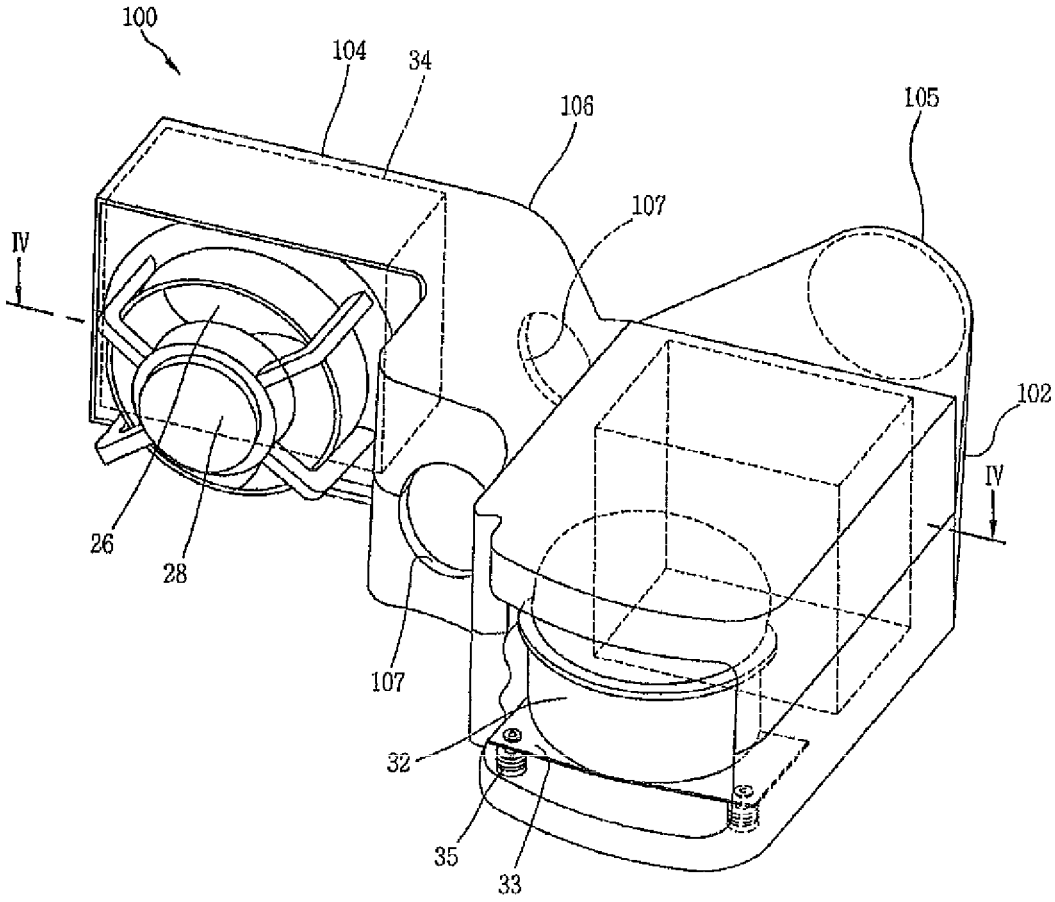
FIG. 3 is a view showing a condenser, a compressor, an evaporator and an expansion valve mounted in the heat pump system modularized housing in FIG. 2.
Figure 4:
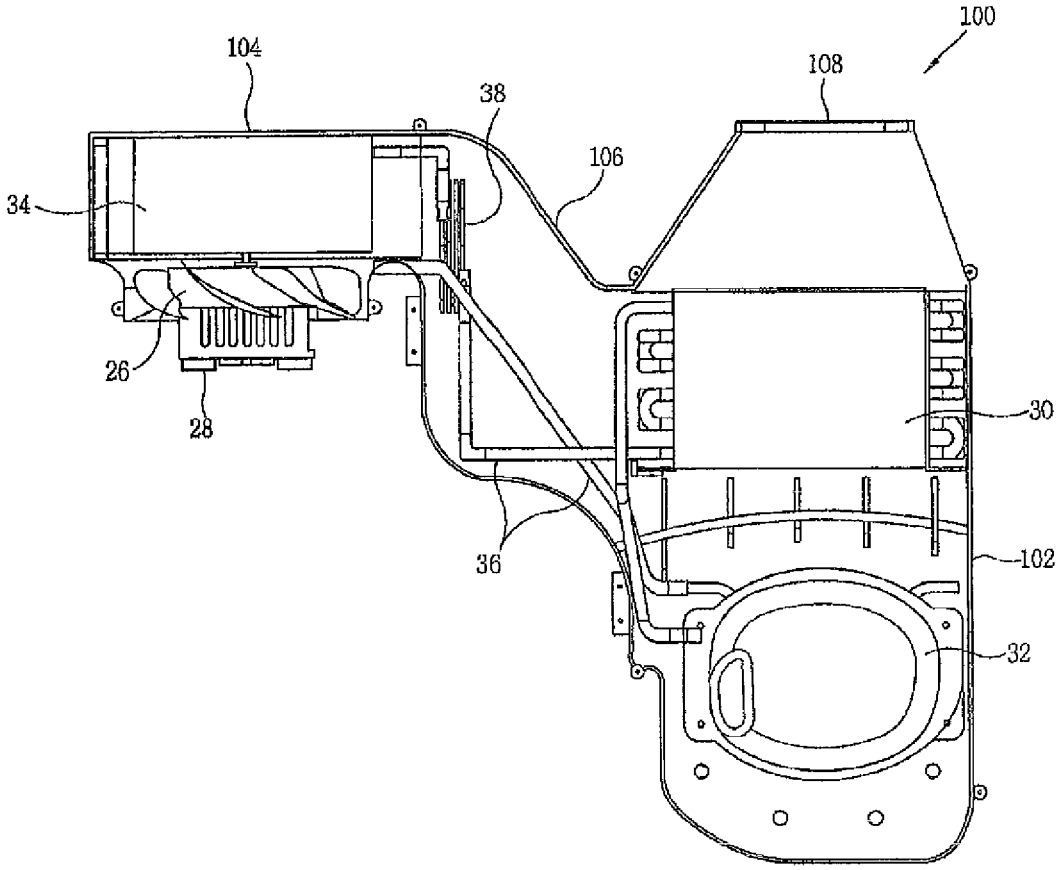
FIG. 4 is a sectional view taken along line IV-IV of FIG. 3.

FIG. 2 is a view showing separated upper and lower portions of a heat pump system modularized housing, FIG. 3 is a view showing a condenser, a compressor, an evaporator and an expansion valve mounted in the heat pump system modularized housing in FIG. 2, and FIG. 4 is a sectional view taken along line IV-IV of FIG. 3.

In employing the above-described heat pump system as the heat source, the heat pump system is modularized within a single structure to allow components that constitute the heat pump system to be effectively mounted and effectively disposed in their spatial relation with other components and simplify the overall assembling process.

With reference to FIGS. 2 to 4, the heat pump system modularized housing 100 is a structure that can be divided into an upper portion and a lower portion. The upper and lower portions can be combined to form a first space part 102, a second space part 104 and an intermediate portion 106 positioned between the first and second space parts 102 and 104.

The intermediate portion 106 maintains a certain space and includes through holes 107 formed at front and rear surfaces thereof.

The first space part 102 includes a first opening 108 formed at one end thereof, and the first opening 108 is connected with a passage through which air is introduced into the drying drum 14.

The second space part 104 includes a second opening (in FIG. 3, 109) formed at one end thereof and the first opening 109 is connected with the rear surface of the clothes dryer and serve as an air outlet passage.

The through holes 107 formed at the intermediate portion 106 between the first and second space parts 102 and 104 correspond to a region where the air outlet duct 24 is inserted. By forming the penetrating structure at the heat pump system modularized housing 100, it may not interfere with each other in terms of a spatial relation with other components of the clothes dryer.

The condenser 30 as the first heat exchanging unit and the compressor 32 are disposed in series at the first space part 102. In order to prevent vibration and noise generated when the compressor 32 is driven, the compressor 32 is installed on the support plate 33 by the fastening means such as the screw. In addition, the support plate 33 is installed at the lower portion of the heat ump system modularizing housing 100 by the screw, and the vibration reducing member 35 such as rubber is insertedly installed between the support plate 33 and the base 66.

The evaporator 34 as a second heat exchanging unit is installed in the second space part 104. Components can be fastened in the heat pump system modularized housing 100 by using the screw or a bonding means. According to circumstances, the lower surface of the heat pump system modularized housing 100 can be shaped to be similar to the exterior of each component so that the components can be mounted without any additional fastening means.

The ducts 36 for connecting the expansion valve 38 and the components are positioned between the first and second space parts 102 and 104. The ducts 36 are passages through which a refrigerant flows, and can be formed such that it cannot spatially interfere with the air outlet duct 24 in consideration of mutual positions.

An auxiliary fan 26 and an auxiliary motor 28 for the auxiliary fan 26 are mounted at a front side of the second space part 104. With this structure, the auxiliary fan 26 is driven by the motor 28, so the air volume and rotational direction can be freely changed.

In the heat pump system modularized housing 100 according to the exemplary embodiment as described above, the first space part 102 has a larger area than that of the second space part 104. In this case, by varying dispositions of the components within the clothes dryer, the relative size of the first and second space parts 102 and 104 can change.

In addition, the condenser 3 and the compressor 32 are mounted in the first space part 102 of the heat pump system, but according to circumstances, the condenser 30 and the evaporator 34 can be mounted together in the first space part 102 while the compressor 32 can be mounted in the second space part.

The heat pump system modularized housing 100 can be made of metal. For example, a platy metal can be cuts into several parts and then combined in a certain shape to thus fabricate an integrated housing.

The heat pump system modularized housing 100 also can be made of a polymer material, and in this case, an integrated structure can be fabricated with a single mold at one time. Various polymer materials can be used, and preferably, a material with good strength and corrosion resistance is used. In the exemplary embodiment of the present invention, an ABS resin is used.

Figure 5:
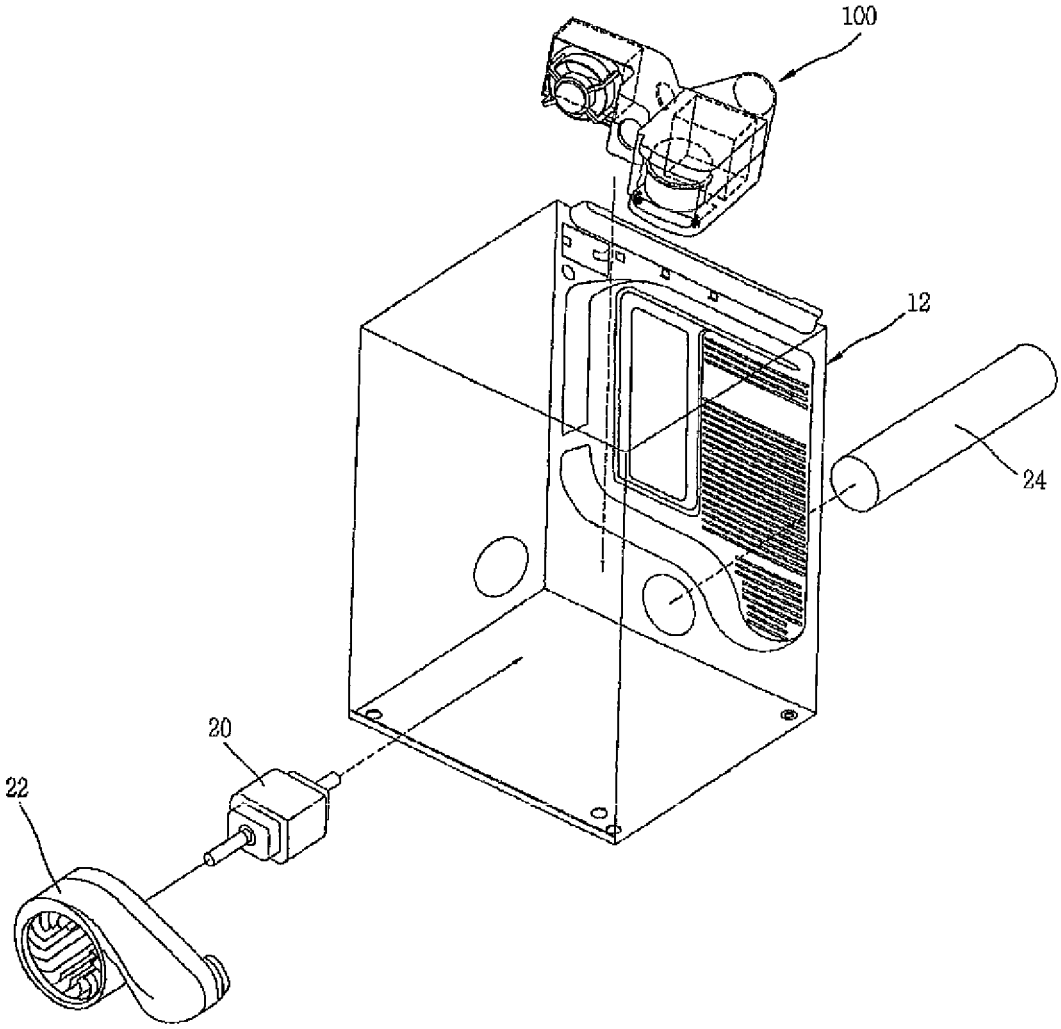
FIG. 5 shows an example of a process of mounting the heat pump system modularized housing in FIG. 2 from an upper side of a cabinet.
Figure 6:
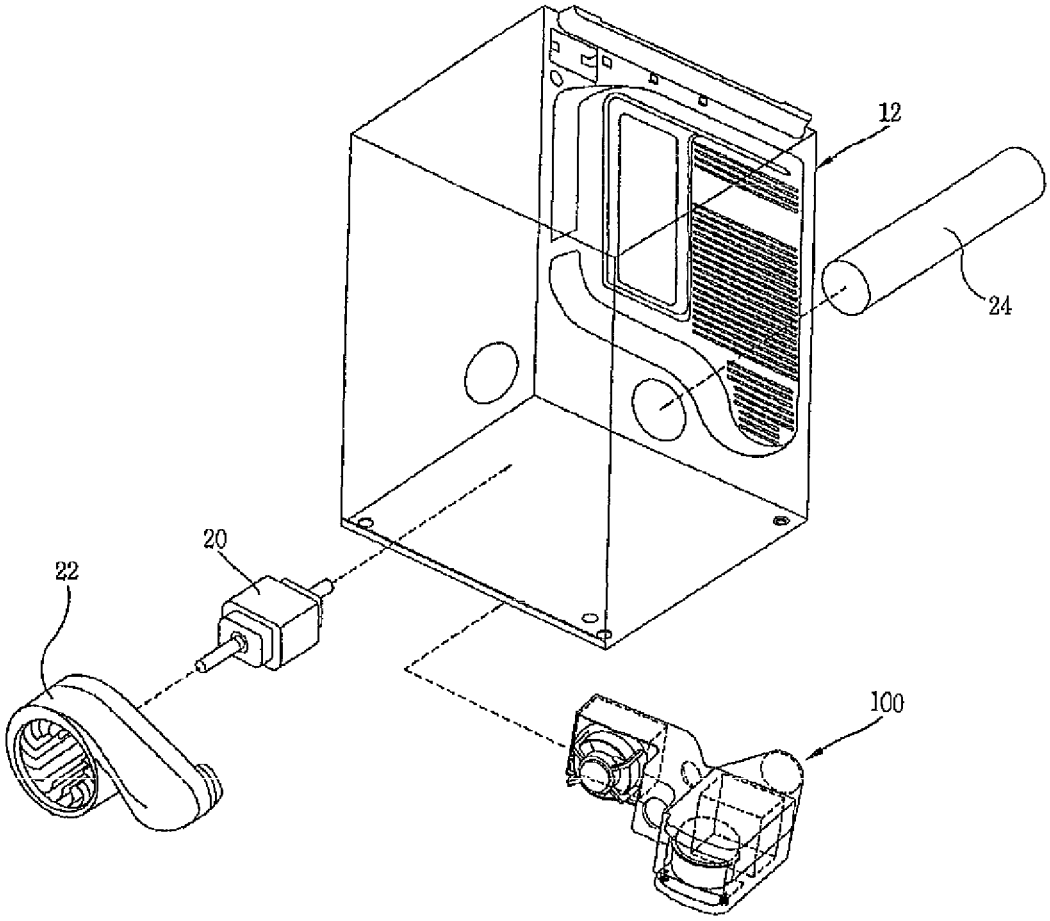
FIG. 6 shows an example of a process of mounting the heat pump system modularized housing in FIG. 2 from the side of the cabinet.

FIG. 5 shows an example of a process of mounting the heat pump system modularized housing in FIG. 2 from an upper side of a cabinet, and FIG. 6 shows an example of a process of mounting the heat pump system modularized housing in FIG. 2 from the side of the cabinet.

With reference to FIG. 5, the heat pump system modularized housing is mounted from the upper side of the cabinet in the following order.

First, the heat pump system modularized housing 100 in which the heat pump system is mounted as a module is mounted on the base 16 in the upward direction, and then, the motor 20, the air flow fan 22, the air outlet duct 24 are sequentially mounted, so that the heat pump system can be spatially effectively disposed in the clothes dryer.

With reference to FIG. 6, the heat pump system modularized housing is mounted from the side of the cabinet in the following order.

First, the heat pump system modularized housing 100 in which the heat pump system is mounted as a module is mounted on the base 16, and then, the motor 20, the air flow fan 22 and the air outlet duct 24 are sequentially mounted, thus spatially effectively mounting the heat pump system in the clothes dryer.

As so far described, the clothes dryer according to the present invention can be implemented for use in the home, in business, for factories, and many other applications.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

The invention claimed is:

1. A clothes dryer comprising:

a cabinet;

a drying drum rotatably installed within the cabinet;

a heat pump system that provides heat to target items to be dried received in the drying drum; and a heat pump system modularized housing that collectively modularizes a condenser, a compressor, an evaporator and an expansion valve that constitute the heat pump system, the housing including:

a first space part providing a first flow path;

a second space part providing a second flow path; and an intermediate part forming space between the first and second space part, wherein the first flow path is independent from the second flow path, wherein the first flow path is a pass through via the condenser, wherein the second flow path is a pass through via the evaporator, wherein a through hole is formed in a wall of the intermediate part, and wherein a first portion of air in the cabinet passes via the condenser along the first flow path and a second portion of air in the cabinet different from the first portion of air passes via the evaporator along the second flow path.

2. The dryer of claim 1, wherein the first flow path is connected with the drying drum.

3. The dryer of claim 1, wherein the second flow path communicates with the exterior.

4. The dryer of claim 1, wherein an air outlet duct is insertedly positioned in the through hole.

5. The dryer of claim 1, wherein the heat pump system modularized housing is divided into upper and lower portions.

6. The dryer of claim 1, wherein the condenser, the compressor, the evaporator and the expansion valve are combined with the heat pump system modularized housing by a fastening unit.

7. The dryer of claim 1, further comprising:

a support plate installed at a lower side of the heat pump system modularized housing and supporting the compressor; and a vibration reducing member installed at a lower side of the support plate and the heat pump system modularized housing.

* * * * *